US007574848B2

(12) United States Patent
Kempsell et al.

(10) Patent No.: US 7,574,848 B2
(45) Date of Patent: Aug. 18, 2009

(54) SADDLES

(76) Inventors: David Kempsell, Little Duskin Farm, Covet Lane Kingston, Canterbury, Kent (GB) CT4 6JS; Margaret L. White, Little Duskin Farm, Covet Lane Kingston, Canterbury, Kent (GB) CT4 6JS ( * ) Notice: Subject to any disclaimer, the term of this patent is extended or adjusted under 35 U.S.C. 154(b) by 277 days.

(21) Appl. No.: 10/511,717

(22) PCT Filed: Apr. 16, 2003

(86) PCT No.: PCT/GB03/01654

§ 371 (c)(1),
(2), (4) Date: Oct. 18, 2004

(87) PCT Pub. No.: WO03/089367

PCT Pub. Date: Oct. 30, 2003

(65) Prior Publication Data

US 2005/0126132 A1 Jun. 16, 2005

(30) Foreign Application Priority Data

Apr. 16, 2002 (GB) ..... 0208660.1
Feb. 12, 2003 (GB) ..... 0303169.7

(51) Int. Cl.
*B68C 1/02* (2006.01)

(52) U.S. Cl. ..... 54/44.7; 54/44.1

(58) Field of Classification Search ..... 54/44.7, 54/44.1, 44.3, 44.4; D30/135
See application file for complete search history.

(56) References Cited

U.S. PATENT DOCUMENTS 914,546 A * 3/1909 Amos ..... 54/44.7
2,034,474 A 3/1936 Knetsch
2,130,442 A * 9/1938 Worcester ..... 54/44.7
3,780,494 A 12/1973 Nakivell, Jr.
4,414,791 A 11/1983 Freeze
5,195,306 A 3/1993 Hadlock
5,343,674 A 9/1994 Brown
5,979,603 A * 11/1999 Woller ..... 182/187
6,363,698 B1 * 4/2002 Swain ..... 54/44.5
2003/0203155 A1 * 10/2003 Kobe et al. ..... 428/119

FOREIGN PATENT DOCUMENTS

| | | |
|---|---|---|
| AT | 406767 | 8/2000 |
| DE | 1976063 | 12/1967 |
| FR | 2162760 | 7/1973 |
| GB | 1439761 | 6/1976 |
| GB | 2071986 | 9/1981 |
| WO | WO-9806662 | 2/1998 |

* cited by examiner

*Primary Examiner*—Son T. Nguyen
(74) *Attorney, Agent, or Firm*—Connolly Bove Lodge & Hutz LLP

(57) ABSTRACT

The present invention relates to a modular saddle. There is provided a saddle having a saddle tree unit, a saddle flap unit and a panel unit, wherein the panel unit and saddle flap unit are removably securable to the saddle tree unit. The flap unit comprises two flap components each having a sweat flap and saddle flap. Each flap component is removable from the saddle tree in one piece. The panel unit includes plates, which extend the bearing surface of the saddle tree, and prevent the formation of pressure points. In another aspect of the present invention there is provided a flexible tree made from a polyurethane resin. The tree further includes a Y-shaped carbon fibre strengthening bar, which enables the tree to flex laterally, but not longitudinally.

24 Claims, 7 Drawing Sheets

SADDLES

The present invention relates to improvements in or relating to saddles. In particular, the present invention relates to a modular saddle having interchangeable units, and a novel saddle tree construction.

Traditionally, a saddle comprises a relatively solid, usually wooden, saddle tree structure, which is used to transfer the weight of the rider evenly over the horse's back via two padded panels, one on each side of the horse's backbone. The panels cushion the horse. Saddle trees are made in several width fittings to accommodate horses of different sizes. A particular problem with traditional saddles is that a solid tree restricts the movement of the horse's shoulders. It is known to provide a substantially flexible tree. However, this does not support the rider's weight sufficiently, and strengthening of the tree is required. A tree-less saddle is also known, but again this provides no support for the rider's weight.

A seat is formed on top of the tree from foam or other soft materials, to cushion the rider. The girth webs and straps, stirrup fixings and panels are permanently fixed to the saddle tree itself. These fixings, particularly the stirrup fixings can protrude from the underside of the tree and cause pressure points, which are damaging to the horse.

A conventional saddle has a flap component on each side of the tree/seat, which separates the rider's leg from the horse. A conventional flap comprises a separate saddle flap and sweat flap. The sweat flap lies against the horse and is secured to the corresponding saddle panel. The saddle flap lies on top of the corresponding sweat flap and is secured to the saddle tree. The front portion of the upper saddle flap usually comprises a knee roll, which cushions the rider's knee. It is therefore beneficial to provide flaps of different lengths to accommodate riders having different leg lengths.

The individual components making up a traditional saddle are usually stitched, stapled or nailed, and glued together, i.e. the components cannot be removed without destroying the saddle.

A saddle is usually custom-made to fit a particular horse and rider. The shape of the tree and length of the flap, for example, will be specific to the shape of the horse's back, and the length of the rider's leg. The saddle flaps will also be selected for the particular discipline of riding that is required. For example, the flaps of a show jumping saddle will be secured at a different angle with respect to the tree than the flaps of a dressage saddle. A finished saddle will therefore only be suitable for a limited number of horses—which have similarly shaped backs. A separate saddle will also be required for each riding discipline. Saddles are expensive to produce, and as a result are often sold second-hand. This results in horses being ridden with ill-fitting saddles, which can damage a horse's back and shoulders.

The present invention seeks to provide a saddle that can be inexpensively tailored to an individual horse and rider, and that is versatile in that it can be easily altered for use on a different horse, or for a different riding discipline. The present invention also seeks to provide a saddle that produces minimal pressure points on a horse's back.

According to the present invention there is provided a saddle for use on a horse's back comprising a combination of a saddle tree unit having a cantle end and a pommel end, a saddle flap unit, and a panel unit, wherein the panel unit and saddle flap unit are removably securable to the saddle tree unit.

In the preferred embodiment, the saddle flap unit comprises two flap components, one securable to each side of the saddle tree unit, wherein each flap component is securable in at least two different orientations. This provides that the saddle can be easily altered for the particular rider using it, and the length of their leg.

Suitably, each flap component comprises an upper saddle flap and a lower sweat flap.

Preferably, the saddle flap unit is bolted to fixings located in the saddle tree unit. It is therefore possible to remove the saddle flaps and sweat flaps by removing the bolts securing the flap unit.

In the preferred embodiment, the saddle tree unit is formed from a flexible material allowing lateral flexing of the tree unit. Lateral flexing allows the horse to move more freely and reduces any damage to the horse's shoulders.

Suitably, the material is a polyurethane resin.

In the preferred embodiment, the saddle tree unit further comprises a Y-shaped strengthening bar wherein the forks of the Y-shape are directed towards the cantle end of the saddle tree unit. Such strengthening means that whilst lateral flexing is not prevented, the tree cannot flex significantly in a longitudinal direction, and that therefore the weight of the rider is fully supported.

Suitably, the strengthening bar is made from carbon fibre. Carbon fibre is particularly suitable as it is lightweight, therefore adding little weight to the horse's back. It has, however, sufficient strength to support and disperse the rider's weight over the tree. Traditionally, carbon fibre has been unsuitable for use in saddles as it is difficult to attach components to by stapling or stitching, for example. In the present invention, the carbon fibre bar is incorporated into a resin, to which other components can easily be stitched or stapled.

In the preferred embodiment, the pommel end of the tree unit is angularly adjustable. Traditional saddles are produced in a limited range of width fittings to correspond to horses having withers of different heights and widths. Preferably, the tree unit further comprises a head plate located near to the pommel end. The head plate defines the shape of the pommel of the saddle and ensures that the saddle does not contact with the horse's withers.

The head plate is formed of a substantially rigid material and is, in one embodiment, formed integrally within the saddle tree unit, in which case the pommel angle can be adjusted by compression of the saddle tree unit by means of an externally applied force, such as in a press. Alternatively, the head plate is secured in an aperture located in the tree unit, in which case, advantageously, a range of head plates are manufactured in order to produce a range of pommel angles. As the tree unit itself is flexible, a wide range of pommel angles can be produced.

In the preferred embodiment, the saddle tree unit includes two recessed portions, one at either side of the tree, near to the pommel end, into which stirrup bars are securable. The saddle tree unit may further include apertures located at both the pommel end and the cantle end, through which a girth web is fixable. Alternatively, the saddle flap unit may further comprise a girth web secured to either the sweat flap or saddle flap.

Advantageously, the panel unit further comprises at least one panel plate. The plate acts to further distribute the weight of the rider by extending the surface area of the tree, and also provides fixing points for the panel itself. Preferably, the panel plates are flexible, to allow the horse to move freely.

The saddle will also have a seat attached to an upper surface of the saddle tree in order to cushion the rider.

According to another aspect of the present invention, there is provided a saddle tree comprising a tree body having a pommel end and a cantle end, the tree body being formed from a flexible material and a generally Y-shaped strengthening bar, wherein the forks of the Y-shape are directed towards the cantle end of the saddle tree.

Preferably, the strengthening bar is made from carbon fibre.

In a preferred embodiment, the pommel end of the saddle tree is angularly adjustable. In order to achieve this, the saddle tree advantageously further comprises a head plate located near to the pommel end. The head plate is preferably malleable and is bendable to produce the required pommel angle. The head plate may be secured in an aperture located in the saddle tree. Alternatively, it may be formed integrally within the saddle tree. Suitably, the head plate is made from malleable steel.

In a preferred embodiment, the saddle tree further includes two recessed portions, one at either side of the tree near to the pommel end, into which stirrup bars are securable.

Advantageously, the saddle tree further comprises at least one sheet of bi-directional carbon fibre.

In a preferred embodiment, the saddle tree further comprises apertures located at both the pommel end and the cantle end, through which a girth web is fixable.

A specific embodiment of the invention will now be described by way of example only and with reference to the accompanying drawings in which.

Figure 1:
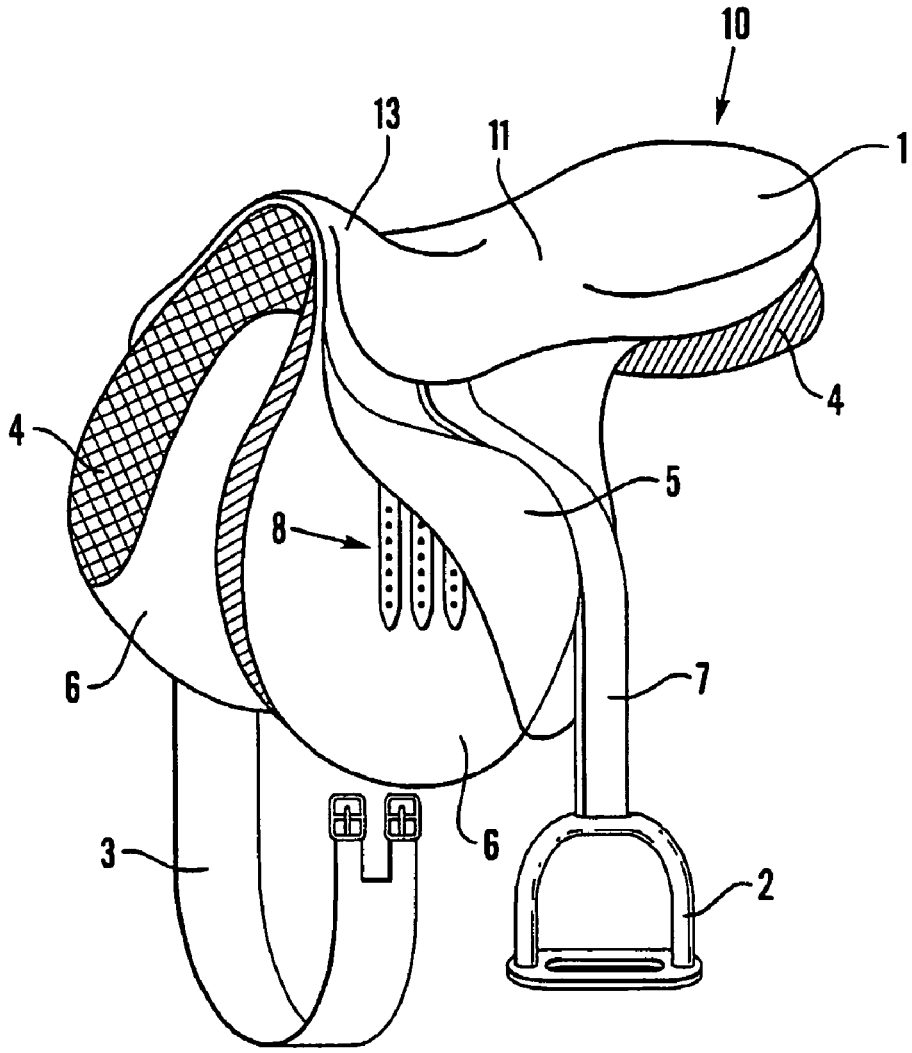
FIG. 1 is a perspective view of a traditional saddle.

To illustrate the present invention, it will be helpful to describe the construction of a conventional saddle. With reference to FIG. 1, there is shown a traditional saddle 10. Each component of saddle 10 described below is normally made from leather, but can also be made from synthetic materials. Saddle 10 has a seat 11, a pommel 13 and a cantle 1. Saddle 10 is secured to a horse by a girth 3.

Figure 2:
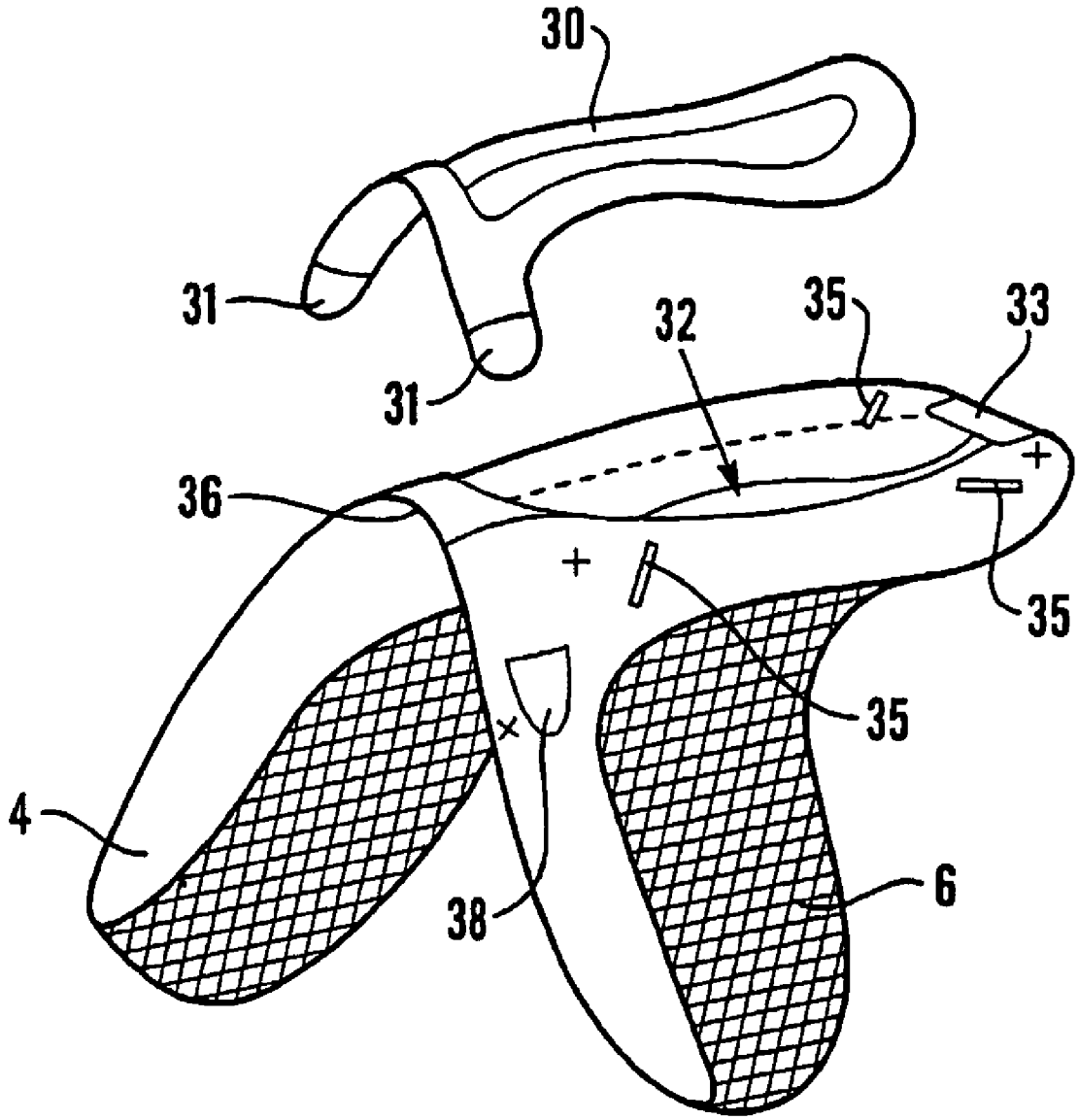
FIG. 2 is a view of a traditional saddle showing the tree, panels and flaps.

With reference to FIG. 2, seat 11 is supported by a saddle tree 30, having a steel head plate. The head plate is attached to tree 30 at a point equidistant between the tree points 31. Saddle tree 30 is traditionally made from wood or polypropylene. Saddle tree 30 is extended by panel 4, which is flocked to cushion the horse and to conform to the shape of a particular horse's back. Tree 30 will compress the flocking and may cause unevenness which will result in pressure points being formed on the horse's back Panel 4 is fixed to tree 30 by stitching or stapling, and gluing.

Girth straps 8 are attached to saddle 10 be means of girth webs (not shown), which are fixed directly to saddle tree 30. Girth straps 8 lie on a sweat flap 6, which is fixed to panel 4 by means of stitching or stapling, and gluing. Sweat flap 6 cannot therefore be removed without destroying the saddle. Sweat flap 6 rests against the horse. A saddle flap 5 lies over sweat flap 6 and girth straps 8. Saddle flap 5 is attached to saddle 10 by nails or other permanent fixing via saddle tree 30. The front portion of saddle flap 5 is normally made of softer leather covering a sheet of foam, to support the rider's knee. This area is known as the knee roll. The knee roll can however, be formed in sweat flap 6 instead of saddle flap 5.

A stirrup leather 7 lies on top of saddle flap 5. Stirrup leather 7 is removably fixable to a stirrup fixing (not shown). The stirrup fixing is riveted to tree 30. The length of stirrup leather 7 is adjustable to allow for riders with different leg lengths. Stirrup leather 7 secures stirrup 2.

Figure 3:
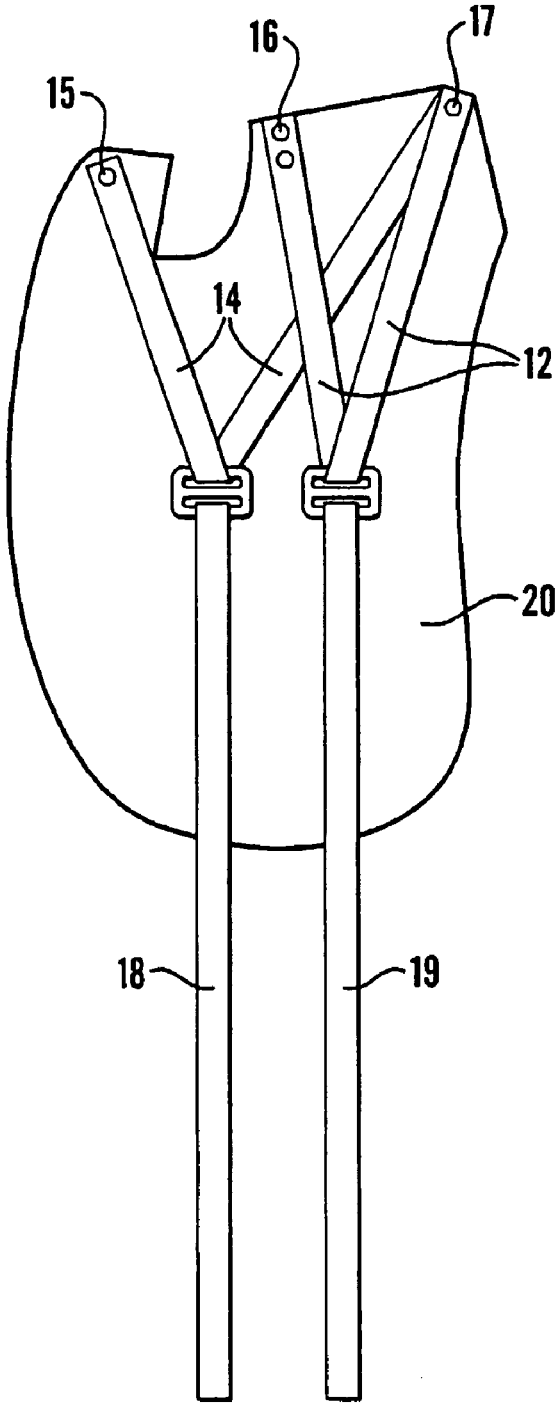
FIG. 3 is a view of an embodiment of a saddle flap unit in accordance with the present invention.

Turning to the present invention and with reference to FIG. 3 there is shown one component 20 of a saddle flap unit having girth webs 12, 14 and girth straps 18, 19. Flap fixing points 15, 16, 17 are used to secure component 20 to a saddle tree having corresponding tree fixing points. Component 20 is fixed to a saddle tree such that it is easily removable. In the preferred embodiment fixing is by means of a threaded bolt. This provides that a user may use the same saddle for different riding disciplines. For example, the disciplines of show jumping and dressage have different requirements for saddle flaps. A dressage saddle provides for the rider having a longer length of stirrup leather, and a more extended leg, and therefore the flap is oriented differently with respect to the seat of the saddle and will be of a different shape. The rider can use different flap unit components 20 on the same saddle.

Figure 4:
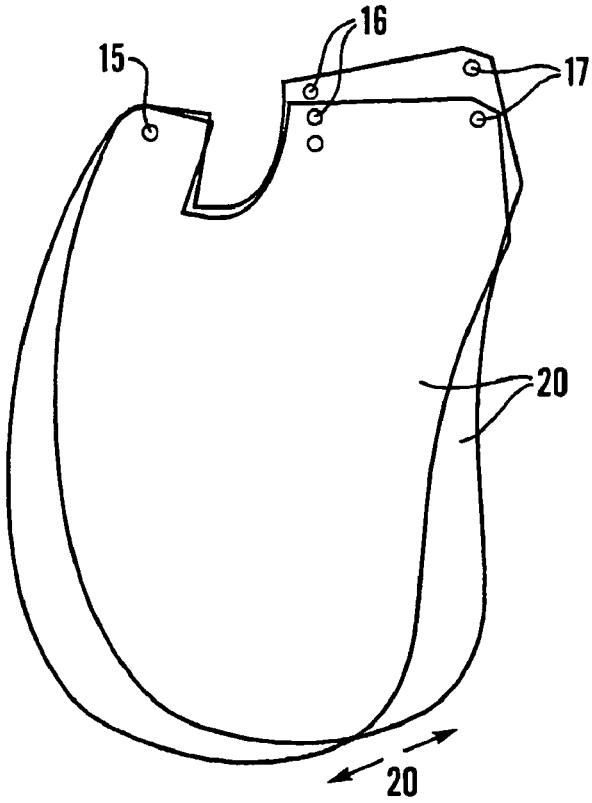
FIG. 4 is a view of an embodiment of the fixings for a flap unit in accordance with the present invention.

With reference to FIG. 4, flap fixing points 15, 16, 17 also allow component 20 to be rotated with respect to the saddle seat. This provides for use of the saddle by riders having different leg lengths.

Figure 5:
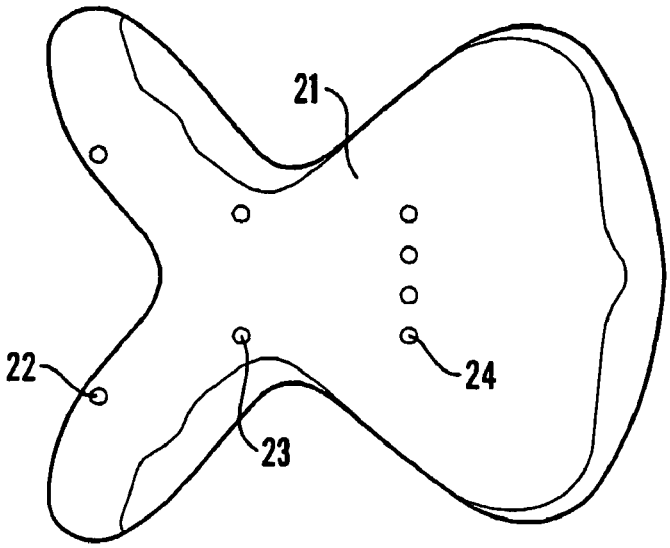
FIG. 5 is a view of the embodiment of FIG. 4 showing the corresponding fixing points on a tree unit.
Figure 6:
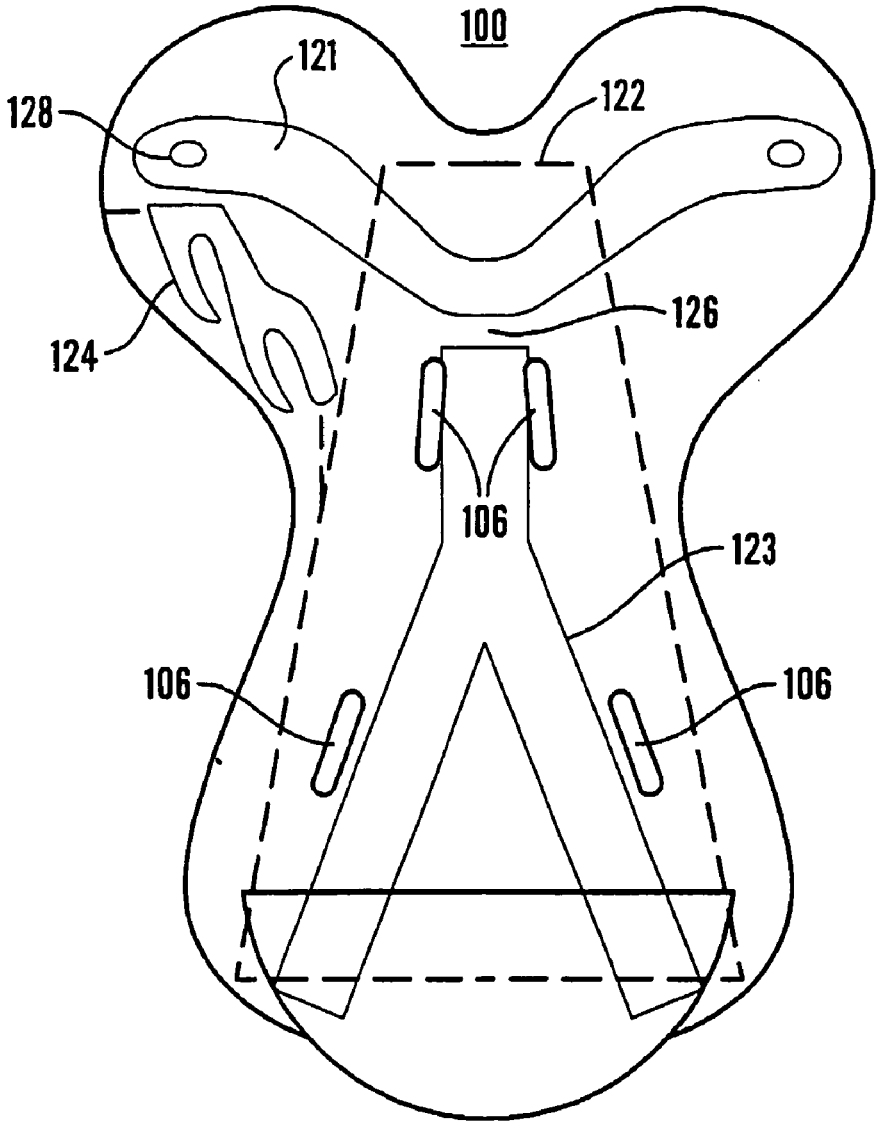
FIG. 6 is a view of an embodiment of a tree unit in accordance with the present invention.

With reference to FIG. 5, component 20 is fixable to a saddle tree 100 (as shown in FIG. 6) at tree fixing points 22, 23, 24. Tree fixing points 22, 23, 24 correspond to flap fixing points 15, 16, 17.

Girth webs 12, 14 are arranged such that an even pressure is exerted over the saddle. Fixing points 15, 16, 17 provide the attachment points for girth webs 12, 14. Girth webs 12, 14 secure two girth straps 18, 19. In the preferred embodiment, girth straps 18, 19 have a series of apertures which engage a pin in a girth (not shown). Each end of the girth is securable to two girth straps. The girth is used to secure the saddle on a horse's back by means of one of the apertures in each girth strap 18, 19 and the pins of the girth. Accordingly, the girth will pull the saddle down at its centre. In this way, if one girth strap 18, 19 is tighter than its partner, the pull of the girth will remain centered and keep the saddle secure on the horse's back.

The construction of the preferred embodiment differs from a traditional saddle 10 in that the flap unit comprises a single component 20 having a sweat flap, saddle flap and girth webs 12, 14. This unit is removable in one piece from the rest of the saddle.

With reference to FIG. 6 there is shown a saddle tree 100 having two ends. At the first end, the pommel end, there is provided a head plate 121. The other end of tree 100 forms the cantle end. Tree 100 is substantially made from a polyurethane resin that is flexible. This resin is primarily used as it provides flexibility whilst also providing a surface to which the other units of the present invention can be removably secured.

A particularly suitable resin has been found to have a Shore hardness of approximately 90 on the "A" scale. For example, polyurethane resin PMC 790 produced by "Smooth-On", Philadelphia, USA, is suitable. The resin can be cast using pour-moulding techniques. In the preferred embodiment, head plate 121 is integrally moulded in the polyurethane resin. This is preferred as it results in a tree 100 having smooth underside, and therefore reduces pressure points. In this case, the mould is a two-part silicon mould. The components that are to be moulded into the resin must be cleaned and prepared with a solution that allows a strong bond to form between the component and the resin. For example, "Shellac" is effective for this purpose. Alternatively, an aperture may be formed in the underside of tree 100 in which head plate 121 can be secured. Preferably, head plate 121 is secured to tree 100 using recessed bolts at fixing points 128, which screw into fittings pre-moulded into tree 100.

Head plate 121 defines the width of the pommel end of tree 100. In the preferred embodiment, head plate 121 is made from malleable steel and can therefore be bent into shape to define a tree 100 of an appropriate width fitting for a particular horse.

This requires that tree 100 has a certain degree of flexibility. Traditional saddles having semi-rigid polypropylene trees can produce only a limited range of pommel widths as the tree will become too stressed if the head plate is bent to angles which differ significantly from the angle to which the tree was originally moulded. Typically, a range of 30° can be produced. The flexibility of tree 100 allows for a larger range of width fittings, with a range as large as 70° being possible.

The flexibility of the resin will allow tree 100 to flex in a lateral direction. This ensures that the horse can move freely and is not unduly restricted by the saddle. When a horse is in motion, its back forms a very different shape to when it is static. When a saddle is fitted to a specific horse, it is produced to conform to the horse's back when it is static. Therefore, when a horse is moving, a traditional saddle will exert particular pressure on the shoulder area. Tree 100 is laterally flexible and therefore exerts significantly less pressure on the horse when it is in motion.

In the preferred embodiment, tree 100 further comprises an integral strengthening bar 123. This ensures that tree 100 can support and distribute the rider's weight, without reducing the lateral flexibility of tree 100. To achieve this, bar 123 is Y-shaped, where the fork of the Y-shape is directed towards the cantle end of tree 100. Preferably, bar 123 is made from carbon fibre that is a minimum of 6 mm thick and roughly 30 mm wide. Suitably, bar 123 is made from 8 layers of 375 g/m$^2$ bidirectional carbon fibre bonded with boat-building-class epoxy resin. This provides strong support to tree 100 without increasing the weight. Most of the articulation will be at a junction 126 between bar 123 and head plate 121.

It is also possible to introduce into saddle tree 100 a single layer of bi-directional carbon fibre sheet 122 above and below all of the integrated components to ensure integrity between components and also to control stiffness. The size and shape of sheet 122 can be tailored to ensure that there is some resistance to excessive twisting of tree 100.

In one embodiment, tree 100 further includes apertures 106. Apertures 106 are used to secure girth webs (not shown). The webbing weaves up through one of apertures 106 from the underside of tree 100 and down through an adjacent aperture 106. The web is prevented from slipping by screws, which are located between apertures 106. The girth webs provide a secure mounting point for girth straps. In the preferred embodiment, as discussed above, the girth webs are secured to flap unit 20, and are hence removable from saddle tree 100.

Tree 100 further comprises an aperture for a stirrup bar 124 on each side of tree 100. Each stirrup bar 124 is located at the pommel end of tree 100 and acts to removably secure a stirrup leather to the saddle. The aperture ensures that the underside of tree 100 remains as one continuous surface and that no additional pressure points are created. The location of stirrup bars 124 and the flexibility of tree 100 mean that when the pommel end of tree 100, having integral or recessed head plate 121, is bent to adjust the pommel angle, stirrup bars 124 will be correspondingly relocated relative to the rest of the saddle. This provides that the relative orientation of the saddle components remains the same.

Figure 7:
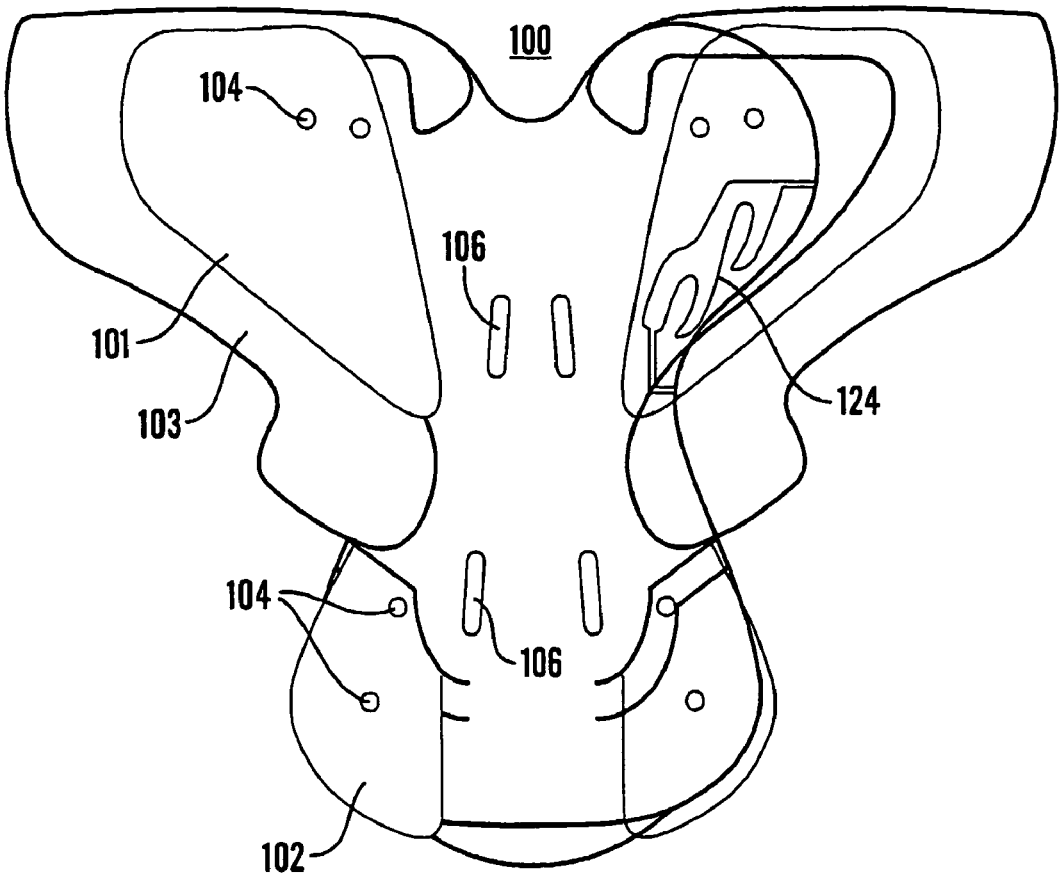
FIG. 7 is a view of the embodiment of FIG. 6 including an embodiment of a flap unit and an embodiment of a panel unit in accordance with the present invention.
Figure 8:
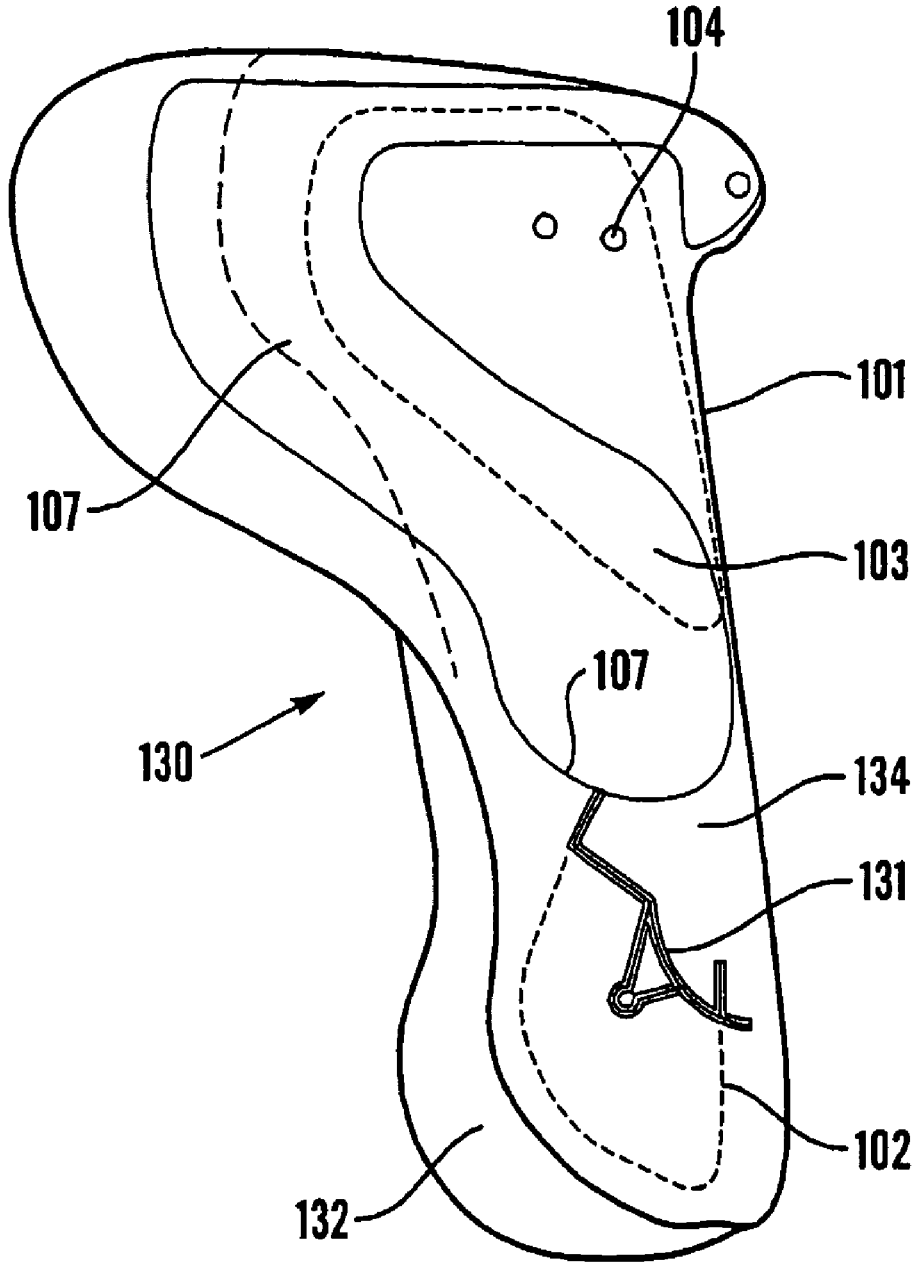
FIG. 8 is a view of an embodiment of a panel unit in accordance with the present invention.

To further ensure that no pressure points are produced, a front plate 101 is secured to each side of tree 100 to cover the area in which stirrup bar 124 is located, as shown in FIG. 7. In the preferred embodiment, front plates 101 are made from a flexible material and are fixed to stirrup bar 124. Front plate 101 also acts as a locating device for a panel 130 (FIG. 8). In the preferred embodiment, plate 101 is made from 1.5 mm polypropylene. Additionally there may advantageously be included a back plate 102 located on the underside of each side of tree 100 at the cantle end of the tree. Plate 102 is preferably made from mild steel and acts like a "burr" on a western style saddle. A burr is an extension of a tree, to which a panel is attached. However, a traditional burr is unsuitable for use in English saddles. Plate 102 inserts into a slot 131 on top of panel 130. Plates 101, 102 also act to further disperse the pressure of the rider and saddle on the horse's back.

With reference to FIG. 8, a panel unit 130 is provided to support the saddle structure on the horse's back and distribute the weight of the rider. Stitch line 107 defines a flocked area 134 of panel 130. In the traditional saddle shown in FIG. 1, it is only the flocked area 4 that transfers the weight of the rider. Panel 130 comprises three pieces of leather or fabric. The first two pieces define the shape of the panel and the third 132 adds depth to the panel. The upper surface of panel 130 is made from a thicker material than the lower surface.

Panel unit 130 is fixed to a panel plate 103, which lies on the top surface of panel 130. Preferably, panel plate 103 is stitched to panel unit 130. Plate 01 is located between plate 103 and the panel top. Plate 103 therefore defines a "pocket" into which plate 101 fits. Panel plate 103 follows the shape of the horse's back, and acts to further disperse the weight of the rider, by extending the bearing surface beyond that achieved by a tree alone. Panel plate 103 is made from a flexible material so that the movement of the horse is not restricted. In the preferred embodiment, panel plate 103 is made from 1.5 mm polypropylene.

From the above description it can be seen that the present invention provides a saddle that is modular but that also retains the appearance of a traditional English saddle. Each component of the saddle can be easily removed and replaced providing a saddle that conforms well to the requirements of the horse and of the rider. The saddle benefits the horse in that the tree can be easily tailored to the shape of its back and will also flex with the horse's movement. Pressure points are also minimized. The saddle benefits the rider in that any length of flap can be combined with the particular tree that is produced for their horse. The present invention also provides cost benefits in that the same basic tree and panel structure can be used for different riding disciplines by changing the flaps.

The invention claimed is:

1. A saddle tree comprising:

a tree body having a pommel end and a cantle end, the tree body being formed from a flexible resin material allowing lateral flexing of the tree;

a head plate disposed within the pommel end of the tree body; and a Y-shaped strengthening bar disposed within the tree body and indirectly coupled to the head plate at a junction formed by the tree body, the junction being a point of articulation for the tree body, wherein the forks of the Y-shape are directed towards the cantle end of the tree body and wherein the strengthening bar is made from carbon fibre.

2. A saddle tree as claimed in claim 1 wherein the strengthening bar is made from bidirectional carbon fibre bonded with epoxy resin.

3. A saddle comprising the saddle tree of claim 2.

4. A saddle tree as claimed in claim 1 wherein the pommel end of the saddle tree is angularly adjustable.

5. A saddle comprising the saddle tree of claim 4.

6. A saddle tree as claimed in claim 1 further comprising a head plate located near to the pommel end.

7. A saddle tree as claimed in claim 6 wherein the head plate is malleable.

8. A saddle comprising the saddle tree of claim 7.

9. A saddle tree as claimed in claim 6 wherein the head plate is securable in an aperture located in the saddle tree.

10. A saddle comprising the saddle tree of claim 9.

11. A saddle tree as claimed in claim 6 wherein the head plate is formed integrally within the saddle tree.

12. A saddle comprising the saddle tree of claim 11.

13. A saddle tree as claimed in claim 6 wherein the head plate is formed from malleable steel.

14. A saddle comprising the saddle tree of claim 13.

15. A saddle comprising the saddle tree of claim 6.

16. A saddle tree as claimed in claim 1 further including two recessed portions, one at either side of the tree near to the pommel end, in which stirrup bars are securable.

17. A saddle comprising the saddle tree of claim 16.

18. A saddle tree as claimed in claim 1 further comprising a sheet of bi-directional carbon fibre applied to at least one of the upper and lower surfaces.

19. A saddle comprising the saddle tree of claim 18.

20. A saddle tree as claimed in claim 1 further comprising girth web apertures located at both the pommel and the cantle end.

21. A saddle comprising the saddle tree of claim 20.

22. A saddle comprising the saddle tree of claim 1.

23. A saddle tree as claimed in claim 1 wherein the flexible resin material is a polyurethane resin.

24. A saddle comprising the saddle tree of claim 23.

* * * * *